US005092250A

United States Patent [19]

Halliar

[11] Patent Number: 5,092,250

[45] Date of Patent: Mar. 3, 1992

[54] ANTI-PILFERAGE DEVICE FOR CONTAINER-CARRYING RAILROAD FLATCARS

[75] Inventor: William R. Halliar, Whiting, Ind.

[73] Assignee: TTX Company, Chicago, Ill.

[21] Appl. No.: 607,515

[22] Filed: Nov. 1, 1990

[51] Int. Cl.[5] ..... B61D 19/00

[52] U.S. Cl. ..... 105/395; 105/394; 410/52; 410/77; 410/121; 410/156; 16/82; 292/32; 292/152; 292/163

[58] Field of Search ..... 105/394, 395; 410/77, 410/121, 153, 117, 156, 52, 72, 71; 16/65, 82; 292/306, 152, DIG. 15, 175, 163, 32, 42, 178

[56] References Cited

U.S. PATENT DOCUMENTS

| | | | |
|---|---|---|---|
| 2,413,782 | 1/1947 | Pumphrey | 292/178 |
| 4,091,741 | 5/1978 | Hartkorn | 410/71 X |
| 4,303,266 | 12/1981 | Volpi | 292/166 |
| 4,462,623 | 7/1984 | Grant | 16/82 |
| 4,854,791 | 8/1989 | Brown | 410/52 |

*Primary Examiner*—Robert J. Oberleitner

*Assistant Examiner*—Kevin D. Rutherford

*Attorney, Agent, or Firm*—Kinzer, Plyer, Dorn, McEachran & Jambor

[57] ABSTRACT

An anti-pilferage device is attached to the car body of a railroad flatcar of the type for carrying containers. The device has a mounting plate attached to the car frame at a point adjacent the doors of a container loaded on the car. A barrier is tiltably supported on the mounting plate in a manner which permits free movement if the barrier is bumped during loading of a container. The barrier is movable between a raised, operative position and a lowered, retracted position. A spring biases the barrier to the operative position, wherein it is in the path of a swinging container door to prevent it from being opened. In the retracted position the barrier is below the level of the container floor. A plurality of anti-pilferage devices may be mounted on the car to accommodate containers of various lengths. The barriers are automatically movable between the retracted position and operative position without the need for manual actuation.

25 Claims, 2 Drawing Sheets

ANTI-PILFERAGE DEVICE FOR CONTAINER-CARRYING RAILROAD FLATCARS

BACKGROUND OF THE INVENTION

This invention relates to railroad flatcars used in the transportation of lading containers. The invention is specifically concerned with an anti-pilferage device which prevents unauthorized opening of the container doors when the containers are on the car.

One of the problems in designing an anti-pilferage device of the type described is the need to accommodate containers of various lengths. The flatcar units are typically designed to carry two 20-foot containers, or one 40, 45 or 48-foot container. Obviously, the placement of a barrier to opening a container door will depend on the length of the container. While it may be possible to use a single barrier for each car unit, such an arrangement would require longitudinal adjustment of its position to accommodate various container lengths. This would necessitate manual movement of the barrier, adding another step to the loading procedure. It is undesirable to add steps to the loading procedure due to the risk that such a step may be neglected or forgotten.

A second approach to providing anti-pilferage devices for multiple container lengths is to provide such devices at the 40, 45 and 48-foot positions. While this approach alleviates the need for longitudinal positioning of the anti-pilferage devices, it still requires displacement of one or more sets of devices when long containers are loaded. For example, if a 48-foot container is loaded, the anti-pilferage devices at the 45 and 40-foot locations must be retracted or otherwise moved out of their operative positions. With known barrier devices, this requires a manual retraction operation, which must be performed prior to loading a long container. As mentioned above, adding steps to the loading procedure is undesirable. Another difficulty with manual retraction of anti-pilferage devices arises when a long container is replaced by a shorter one. In that situation the previously-retracted anti-pilferage device must be moved back to its operative position.

Another problem with multiple sets of devices is that they are subject to damage during loading of containers unless they are retracted. Since the devices are necessarily closely adjacent the end of a container, they are subject to being bumped during loading and unloading operations.

SUMMARY OF THE INVENTION

This invention concerns an anti-pilferage device which prevents unauthorized opening of the doors of lading containers mounted on railroad flatcars.

A primary object of the invention is an anti-pilferage device of the type described which is movable between a raised, operative position and a lowered, retracted position without the need for manual operation or actuation of the device.

Another object of the invention is an anti-pilferage device of the type described which is loosely mounted on the flatcar so that it can move freely in all directions if it is bumped by a container being loaded or unloaded.

Another object of the invention is an anti-pilferage device which is spring-biased to its operative position, and which is movable to its retracted position along a linear, vertical path such that placement of a container on top of a device will cause it to retract.

A further object of the invention is a device which is loosely mounted to the flatcar so that it is freely movable during container loading and unloading, but which is held fixed by a loaded container.

Yet another object of the invention is an anti-pilferage device having a container-actuated locking member which inhibits retraction of the device when a container is loaded on a car.

These and other objects are realized by an anti-pilferage device having a mounting plate suitable for attachment to the car at a location adjacent the doors of a container loaded on the car. A barrier is tiltably supported on the mounting plate such that it is freely movable if bumped by a container being loaded or unloaded. The barrier is spring biased to a raised, operative position, in which the barrier is in the path of a swinging container door to prevent it from being opened. The barrier is also movable to a lowered, retracted position, in which the barrier is below the level of the container. Thus, if a long container is placed over a device located for a shorter container, the barrier of that device will move linearly, under the weight of the container, to a retracted position.

A stabilizer plate connected to the barrier extends towards the location of a container. When the container is placed on the car, it contacts the stabilizer plate, which holds the otherwise tiltable barrier in a rigid, upright position.

DETAILED DESCRIPTION OF THE INVENTION

Figure 1:
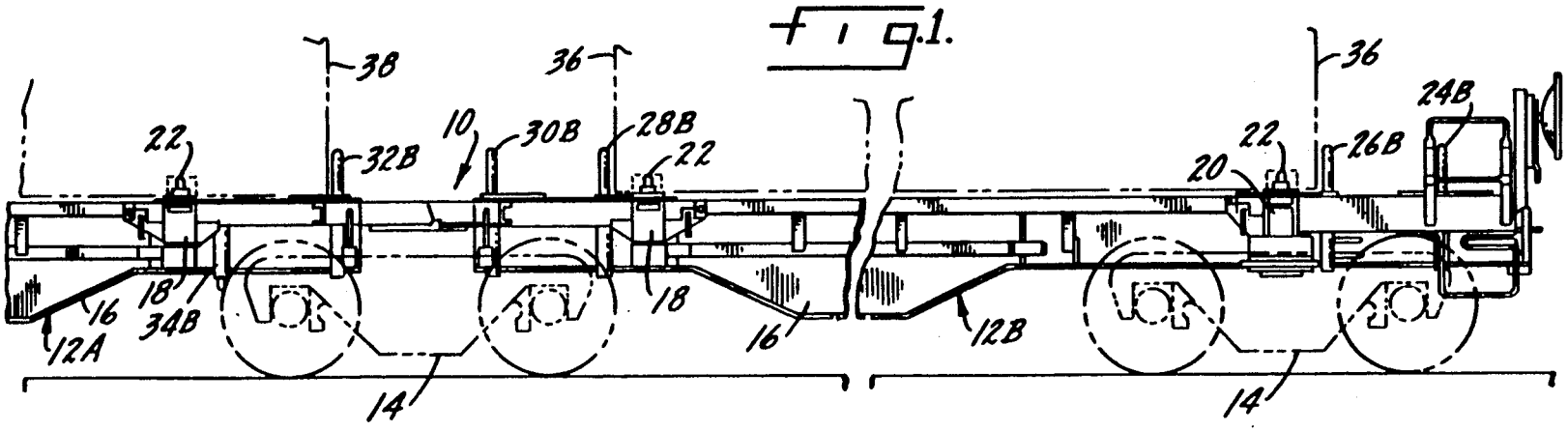
FIG. 1 is a side elevation view, with portions broken away, of a railroad flatcar having anti-pilferage devices of the present invention installed thereon.
Figure 2:
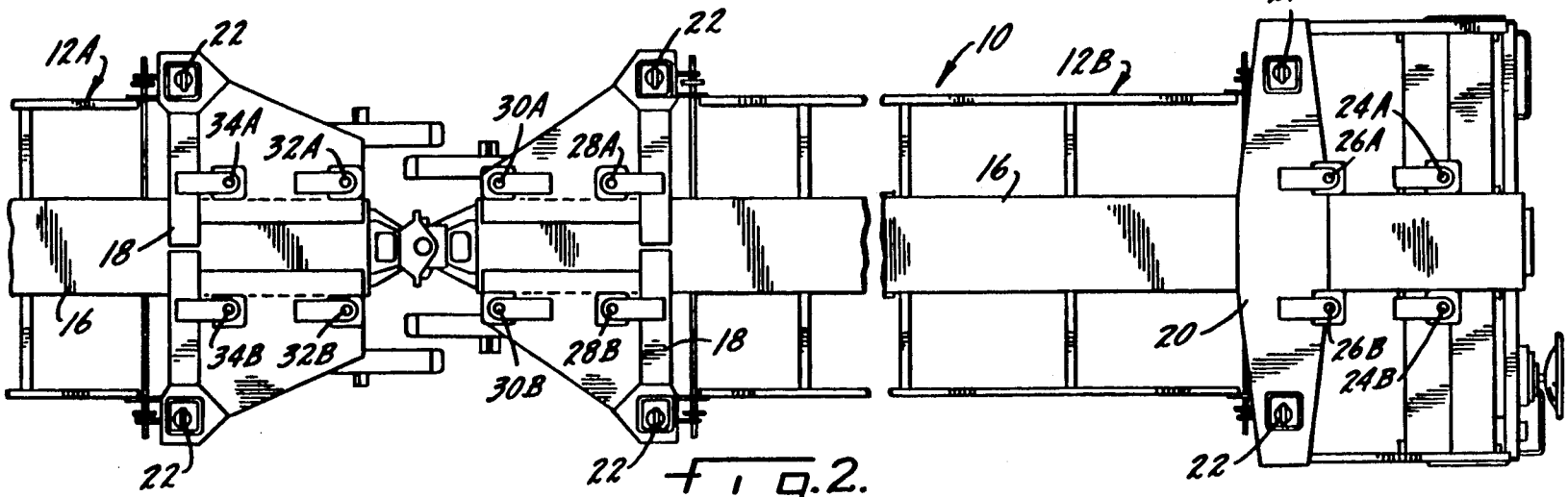
FIG. 2 is a plan view of the flatcar of FIG. 1.

A railroad flatcar of the present invention is shown generally at 10 in FIGS. 1 and 2. In this embodiment the flatcar is shown as an articulated car having multiple platforms or units. Portions of an intermediate unit 12A and an end unit 12B are shown. The units are supported on trucks 14, one or more of which may be shared at articulated joints.

The units 12 have center sills 16 with transversely mounted bolsters 18 attached near the ends of the sills. The end unit has a bolster 20 of a slightly different configuration. Outer container retention means 22 are fastened near the ends of the bolsters 18 and 20. The retention means may be known automatic twist locks connecting two container bottom fittings. Any one of numerous known container securement devices which attach to container bottom securement fittings can be used. The bolsters and retention means are located such that they are spaced to connect to the corner securement fittings found on standard 40-foot containers. The capability exists for carrying longer containers for the reason that typically such longer containers include fittings positioned at the spacing of corner fittings on a 40-foot container. Thus, all such containers can be attached to platforms 12. Further details of the construction of the car are shown in U.S. Pat. No. 4,947,760, which is assigned to the present assignee. The disclosure of that application is incorporated herein.

FIGS. 1 and 2 illustrate the placement of the anti-pilferage devices on the car. The devices are attached to the center sill 16 in pairs numbered 24A,B–34A,B. The devices 26, 28 and 34 are located near the bolsters 18 and 20, adjacent the location of the ends of a 40-foot container. Such a container is illustrated in phantom at 36 in FIG. 1.

The anti-pilferage devices 24, 30 and 32 have a longitudinal position on the car adjacent the locations where the ends of a 45-foot container will be. A 45-foot container is shown in phantom at 38 in FIG. 1. It will be noted that the container 38 is adjacent devices 32 and rests on top of the devices 34. The loading of a 45-foot container 38 actually pushes the devices 34 to a retracted position, as will be further explained below.

Figure 3:
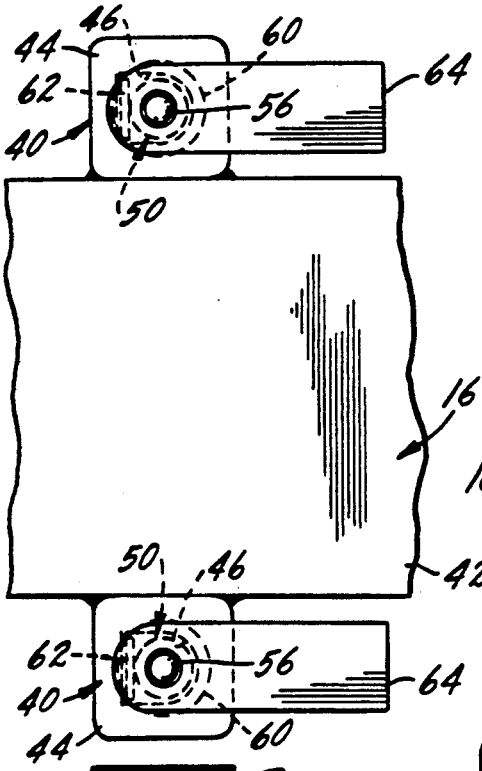
FIG. 3 is a plan view, on an enlarged scale, of one set of anti-pilferage devices.

Details of a particular anti-pilferage device are shown in FIGS. 3–7. FIG. 3 illustrates a pair of devices 40 mounted on each side of the center sill top cover plate 42.

Each device includes a mounting plate 44 which is welded to the center sill top cover plate 42. For reference purposes only, the mounting plate may be about eight inches square. The mounting plate has a D-shaped central opening 46, having a straight side 48.

Each anti-pilferage device also has a barrier supported by the mounting plate and movable between a raised, operative position and lowered, retracted position. In the raised position the barrier is in the path of a swinging container door to prevent it from being opened. In the retracted position the barrier is located underneath a container. In the embodiment shown, the barrier includes a pin assembly 50 which fits loosely through the central opening 46 in the mounting plate 44. The pin assembly 50 includes an elongated, hollow tube 52. The tube is partially closed at the bottom by a plug 54. The plug has a central hole.

An elongated pin or rod 56 fits inside the tube. A collar (not shown) is welded to the pin 56 at about its midpoint. The collar abuts the upper end of a spring 58, which surrounds the lower portion of the pin 56. The bottom of the spring is held in the tube 52 by the plug 54. Thus, the spring is trapped between the plug 54 and the collar on the pin 56. It will be noted that the ends of the pin 56 are rounded. This makes it difficult to use a pry bar to force the pin below a swinging door clearance. The pin may be about two feet long.

The pin assembly 50 further includes a retainer plate 60 welded to the exterior of tube 52 near the top thereof. An anti-rotation device in the form of plate 62 is welded to the retainer plate 60. Plate 62 cooperates with the straight edge 48 of opening 46 to prevent rotation of the pin assembly 50 about a vertical axis, through the mounting plate opening.

Figure 4:
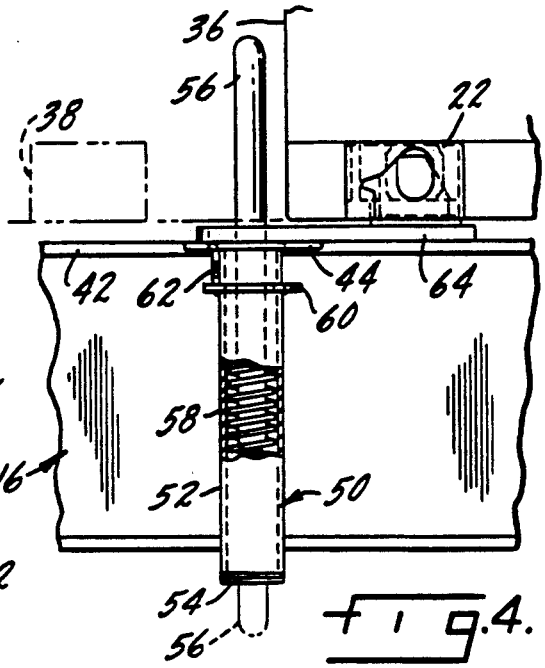
FIG. 4 is a side elevation view, with portions in section, of the anti-pilferage device.
Figure 5:
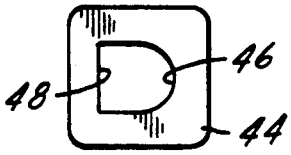
FIG. 5 is a plan view of the mounting plate.
Figure 6:
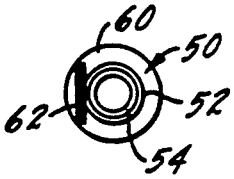
FIG. 6 is a plan view of the spring assembly.

The pin assembly is completed by a stabilizer plate 64, which is welded to the top edge of the tube 52. The stabilizer plate has an opening through which the pin 56 extends. For reference purposes, the stabilizer plate has an overall length of about sixteen inches. It extends toward the location where a container will be placed. Thus, as seen in FIG. 4, when a container is loaded on a car, it will contact the upper surface of the stabilizer plate. This orientation of the stabilizer plate is maintained by the cooperating surfaces of the plate 62 and straight edge 48 of the mounting plate.

Figure 7:
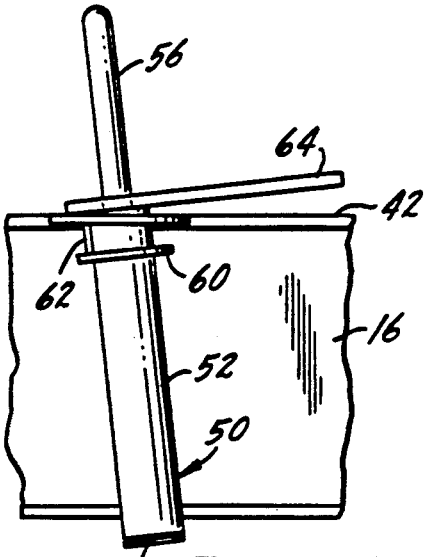
FIG. 7 is a side elevation view of the device shown in a tilted condition.
Figure 8:
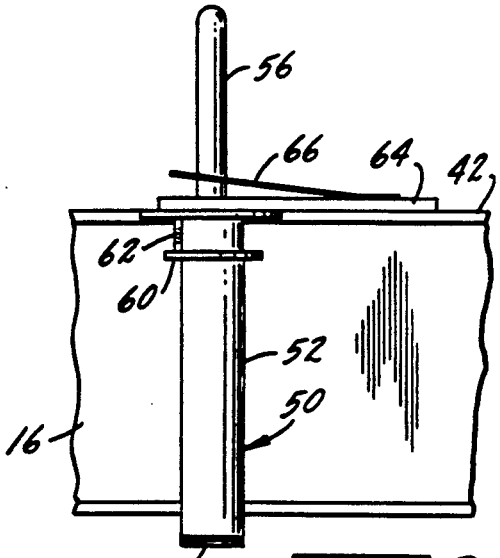
FIG. 8 is side elevation view of an alternate embodiment of the invention.

FIG. 8 illustrates an alternate embodiment. The only difference between this embodiment and that of FIGS. 3–7 is the addition of a spring lock 66. The spring lock is attached to the stabilizer plate 64 and has an opening through which the pin 56 extends. When a container is loaded adjacent the anti-pilferage device, the container body pushes the spring lock 66 downwardly, pinching the pin 56 in its upright position. This affords further resistance to a pry bar.

The use, operation and function of the invention are as follows. Prior to loading of a container, the spring assembly is loosely mounted in mounting plate 44. This loose fit allows the device to move freely in all directions should it be bumped by a container being loaded. This is illustrated in FIG. 7. While the spring assembly is tiltable in all directions, it is not rotatable due to the interference of the plate 62 in the opening 46. Thus, the stabilizer plate 64 is always presented to the underside of a container loaded adjacent an anti-pilferage device. When the container is loaded, it rests on the stabilizer plate, as seen in FIG. 4. This prevents free movement of the anti-pilferage device and causes the pin assembly 50 to stand up rigidly. The pin 56 acts as a barrier, which is in the path of a swinging container door, preventing it from being opened.

When a long container is loaded over a device located at a shorter container location, the pin 56 is pushed down into the spring housing or tube 52 by the weight of the container. This gets the pin out of the way. When the long container is removed the spring 58 will cause the pin to extend back out to its raised, operative position. It is then ready for operation if a short container is loaded next. It can be seen that the movement of the pin 56 from its raised, operative position to a lowered, retracted position is along a vertical, linear path. This makes it possible for the device to be moved out of the way simply by the loading of a long container. When the long container is removed the spring returns the device to its raised, operative position. Thus, no manual operation or actuation of the device is required. The spring allows the device to retract under the weight of a long container, while returning it to an active position, ready for a short container.

The springs have been designed with the proper travel and stiffness to prevent unauthorized opening of container doors, while allowing loading of long containers over the pin assembly. For reference purposes, the spring has an installed height of about 18½ inches and a spring rate of 35 pounds per inch. About 192 pounds are required to compress the pin to the bottom of a door, and about 352 pounds are required to compress the pin to the bottom of a container.

Whereas a preferred form of the invention has been shown and described, it will be realized that modifications could be made thereto without departing from the scope of the following claims.

I claim:

1. An anti-pilferage device for use on railroad cars of the type adapted to carry at least one lading container, comprising:

a mounting plate suitable for attachment to the car at a point adjacent the doors of a container loaded on the car;

a barrier tiltably supported by the mounting plate such that is can be tilted if bumped by a container being loaded, the barrier being movable between a raised, operative position, in which the barrier is in the path of a swinging container door to prevent it from being opened, and a lowered, retracted position, in which the barrier is below the level of the container;

a stabilizer plate connected to the barrier and extending toward the location of a container such that when a container is loaded it rests on the stabilizer plate to prevent tilting movement of the barrier; and spring means for biasing the barrier to the operative position.

2. The device of claim 1 wherein the barrier is supported by the mounting plate such that its movement between the operative and retracted positions can be effected by a linear force whereby placement of a container on top of the device will cause retraction of the barrier.

3. The device of claim 2 wherein the barrier is a pin, normally disposed on a vertical axis.

4. The device of claim 3 wherein the top of the pin is rounded.

5. The device of claim 1 further comprising a spring housing supported by the mounting plate and in which the barrier and spring are disposed.

6. The device of claim 5 wherein the spring housing and mounting plate have anti-rotation means for maintaining the orientation of the stabilizer plate relative to the location of a container.

7. The device of claim 1 further comprising locking means connected to the stabilizer plate so as to be actuatable by placement of a container on the car, the locking means being engageable with the barrier to inhibit retraction of the barrier after loading of a container.

8. The device of claim 1 further comprising locking means connected to the device so as to be actuatable by placement of a container on the car, the locking means being engageable with the barrier to inhibit retraction of the barrier after loading of a container.

9. An anti-pilferage device for use on railroad cars of the type adapted to carry at least one lading container, comprising:

a mounting plate suitable for attachment to the car at a point adjacent the doors of a container loaded on the car;

a barrier supported by the mounting plate and movable between a raised, operative position, in which the barrier is in the path of a swinging container door to prevent it from being opened, and a lowered, retracted position, in which the barrier is below the level of the container, and wherein the barrier is tiltably supported on the mounting plate such that it is at least partially tiltable if bumped by a container being loaded; and a stabilizer plate connected to the barrier and extending toward the location of a container such that when a container is loaded it rests on the stabilizer plate to prevent tilting movement of the barrier.

10. The device of claim 9 wherein the barrier is supported by the mounting plate such that its movement between the operative and retracted positions can be effected by a linear force whereby placement of a container on top of the device will cause retraction of the barrier.

11. The device of claim 10 wherein the barrier is a pin, normally disposed on a vertical axis.

12. The device of claim 11 wherein the top of the pin is rounded.

13. The device of claim 9 further comprising spring means for biasing the barrier to the operative position and a spring housing supported on the mounting plate and in which the barrier and spring are disposed.

14. The device of claim 13 wherein the spring housing and mounting plate have anti-rotation means for maintaining the orientation of the stabilizer plate relative to the location of a container.

15. The device of claim 9 further comprising spring means for biasing the barrier to the operative position.

16. The device of claim 9 further comprising locking means connected to the stabilizer plate so as to be actuatable by placement of a container on the car, the locking means being engageable with the barrier to inhibit retraction of the barrier after loading of a container.

17. The device of claim 9 further comprising locking means connected to the device so as to be actuatable by placement of a container on the car, the locking means being engageable with the barrier to inhibit retraction of the barrier after loading of a container.

18. A railroad car adapted to carry at least one lading container of various lengths, comprising at least two trucks and a car body mounted thereon and a plurality of anti-pilferage devices mounted on the car body for preventing unauthorized opening of the container doors, the anti-pilferage devices being automatically operable with containers of various lengths without manual actuation, each device comprising:

a mounting plate suitable for attachment to the car at a point adjacent the doors of a container loaded on the car;

a barrier tiltably supported by the mounting plate such that is can be tilted if bumped by a container being loaded, the barrier being movable between a raised, operative position, in which the barrier is in the path of a swinging container door to prevent it from being opened, and a lowered, retracted position, in which the barrier is below the level of the container;

a stabilizer plate connected to the barrier and extending toward the location of a container such that when a container is loaded it rests on the stabilizer plate to prevent tilting movement of the barrier; and spring means for biasing the barrier to the operative position.

19. The device of claim 18 wherein the barrier is supported by the mounting plate such that its movement between the operative and retracted positions can be effected by a linear force whereby placement of a container on top of the device will cause retraction of the barrier.

20. The device of claim 19 wherein the barrier is a pin, normally disposed on a vertical axis.

21. The device of claim 20 wherein the top of the pin is rounded.

22. The device of claim 18 further comprising a spring housing supported by the mounting plate and in which the barrier and spring are disposed.

23. The device of claim 22 wherein the spring housing and mounting plate have anti-rotation means for maintaining the orientation of the stabilizer plate relative to the location of a container.

24. The device of claim 18 further comprising locking means connected to the stabilizer plate so as to be actuatable by placement of a container on the car, the looking means being engageable with the barrier to inhibit retraction of the barrier after loading of a container.

25. The device of claim 18 further comprising locking means connected to the device so as to be actuatable by placement of a container on the car, the locking means being engageable with the barrier to inhibit retraction of the barrier after loading of a container.

* * * * *